United States Patent [19]

Hebert

[11] Patent Number: 4,595,372

[45] Date of Patent: Jun. 17, 1986

[54] WATER EJECTOR AND INJECTOR ATTACHMENT FOR BOATS

[76] Inventor: Gary Hebert, Rte. #1, Box 245, Jeanerette, La. 70544

[21] Appl. No.: 740,495

[22] Filed: Jun. 3, 1985

[51] Int. Cl.[4] ..... B63H 21/10

[52] U.S. Cl. ..... 440/88; 114/185

[58] Field of Search ..... 440/88, 89, 113, 900, 440/183 R, 183 A, 185; 43/55

[56] References Cited

U.S. PATENT DOCUMENTS

| | | | |
|---|---|---|---|
| 1,099,684 | 6/1914 | Barlow et al. | 440/88 |
| 2,627,242 | 2/1953 | Kiekhaefer | 114/183 R |
| 2,672,114 | 3/1954 | McCartney | 114/185 |
| 3,029,769 | 4/1962 | Kiekhaefer | 440/89 |
| 4,074,651 | 2/1978 | Arduser | 114/183 R |

*Primary Examiner*—Trygve M. Blix
*Assistant Examiner*—Jesûs D. Sotelo
*Attorney, Agent, or Firm*—George A. Bode

[57] ABSTRACT

A water ejector and injector attachment for the motor of a boat comprising a motor adapted to be secured to the frame of the boat carrying a propeller at its lower end and defining a cavitation plate extending rearwardly thereof and having a bore therethrough, at least one recess in the lower surface of the cavitation plate; a trim tab projecting downwardly from the cavitation plate and positioned adjacent rearwardly of the propeller, the trim tab having a passageway therethrough having one end communicating with the bore of the cavitation plate, and a plate member integral therewith and having at least one protrusion upwardly extending therefrom, each of said protrusions mating in the recesses in the cavitation plate; an elongated tube provided through the bore in the cavitation plate with one end secured to and communicating with the passageway of the trim tab and the other end terminating in the bilge of the boat; a spring biasing the trim tab upwardly whereby the protrusions engage the recesses in the cavitation plate; and a handle for moving the trim tab downwardly to disengage the protrusions from the recesses thereby allowing rotational movement of the trim tab.

11 Claims, 4 Drawing Figures

WATER EJECTOR AND INJECTOR ATTACHMENT FOR BOATS

BACKGROUND OF THE INVENTION

1. Field of the Invention

The present invention relates to a combination water ejector and injector attachment for motors for boats and more particularly to a combination boat bailer and forced aerating apparatus attachment for motors for boats for extracting bilge water from the bilges of a boat and for supplying aerated water to the boat while moving or stationary.

2. General Background

In a boat with an outboard or inboard motor, seepage of water into the boat is a problem. While the boat may be watertight when floating at the dock, the vibration of the motor when the boat is being driven has a tendency to open the seams permitting water to enter. Therefore, it is imperative that the water be removed quickly from the boat.

In the boating industry boats have been propelled by motors, particularly outboard motors, having a water pump or other suitable means for forcing water through the cylinders of the engine for cooling the engine and for maintaining fish-bait in a desirable condition or for washing down the boat while "running in" to port.

Several attempts have been made in the prior art to develop a mechanical system for extracting bilge water from the bilges of a boat by having a venturi positioned either forwardly or rearwardly of the outboard motor propeller and a tubing connected to the venturi terminating in the bilge of the boat for extracting water from the bilges when the propeller of the boat is in operation and forcing water through the venturi. Different patents directed to using such structure have been issued:

U.S. Pat. No. 2,771,052 issued to M. L. Halverson entitled, "Boat Bailer;"

U.S. Pat No. 2,530,664 issued to C. F. Pye entitled, "Boat Bailer;"

U.S. Pat. No. 2,711,151 issued to R. L. Shumacker entitled, "Water Removing System for Boats;"

U.S. Pat. No. 2,627,242 issued to E. C. Kiekhaefer entitled, "Boat Bailing Attachment for Outboard Motors;" and U.S. Pat. No. 2, 604,867 issued to J. Frye entitled, "Bilge Water Ejector for Outboard Motors."

Different patents are directed to apparatus adjacent to the propeller for supplying aerated water to the boat while moving or stationary.

U.S. Pat. No. 2,151,225 issued to W. Newton is entitled, "Live Bait Container" and discloses a system for pumping water from the body of water to a container aboard the boat. The submerged apparatus has inlet ports that are placed fore of the propeller connected to a passageway that empties into the container.

U.S. Pat. No. 4,074,651 issued to D. H. Arduser is entitled, "Forced Aerating Means For Inboard Live Wells;"

U.S. Pat. No. 3,946,694 issued to R. Belsky and is entitled, "Automatic Emergency Bilge Water Pumpout System." Here, as in the Arduser'651 Patent, fluid flow is not induced by movement of the propeller.

GENERAL DISCUSSION OF THE PRESENT INVENTION

The present invention solves the prior art problems and shortcomings in a simple and inexpensive straight forward manner. The present invention provides an apparatus for both extracting bilge water from the bilges of a boat and supplying aerated water thereto while the boat is moving or stationary.

In the preferred embodiment, the water injector and ejector attachment for a boat comprises an outboard motor adapted to be secured to the frame of the boat carrying a propeller at the lower end thereof and defining a cavitation plate extending rearwardly thereof and having a bore therethrough, at least one recess in the lower surface of the cavitation plate; and, a trim tab of a generally finned shape projecting downwardly from the cavitation plate and positioned adjacent and rearward of the propeller, and having a passageway therethrough having one end communicating with the bore of the cavitation plate, and an upper plate member integral therewith having at least one protrusion upwardly extending therefrom, each of said protrusions selectively mating with the recesses of the cavitation plate thereby securing the trim tab to the cavitation plate; an elongated tubular member provided through the bore in the cavitation plate having one end secured to the cavitation plate and communicating with the passageway of the trim tab and its other end terminating in the bottom (bilge) of the boat for providing a passageway for bilge water; a spring for biasing the trim tab upwardly thereby engaging the protrusion within the recesses; and a handle for moving the trim tab against the bias of the spring for disengaging the protrusions from mating relationship with recesses thereby allowing rotation of the trim tab from a position wherein the passageway in the trim tab faces away from the propeller thereby creating a vacuum therein for extracting bilge water from the boat, to a second position wherein the passageway in the trim tab faces the propeller thereby creating a force for introducing water into the boat.

Thus, it is an object of the present invention to provide a simple and inexpensive combination apparatus for extracting bilge water from the bilges of a boat and introducing aerated water into the boat while it is moving or stationary.

It is a further object of the present invention to provide a combination mechanical water injector and ejector without the need for an electrical pump.

It is yet another object of the present invention to provide a combination injector and ejector attachment for the motor of a boat which operates at all times if the propeller is rotating and does not depend upon movement of the boat through the water.

It is yet another object of the present invention to provide an attachment for the motor of a boat for extracting bilge water from the bilges of the boat having a venturi position rearwardly of the outboard motor propeller and a tubing connected to the venturi and terminating in bilges of the boat for extracting water from the bilges of the boat when the boat is in operation and forcing water through the venturi.

It is yet another object of the present invention to provide an apparatus for providing a supply of water to a boat having a tubular member connected to a trim tab having a passageway therein positioned rearwardly of the outboard motor propeller and terminating in the bilges of the boat for providing water to the bilges when the propeller of the boat is in operation and forcing water through the trim tab and tubular member.

It is a further object of the present invention to provide structure for selectively mating the trim tab and cavitation plate to allow for extracting bilge water from the bilge of the boat or supplying water to the boat.

It is yet a further object of the present invention to provide means for disengaging the trim tab from the cavitation plate to allow rotation of the trim tab from a position wherein the propeller creates a vacuum thereby extracting water from the boat to a second position wherein the propeller creates a force for introducing water into the boat.

BRIEF DESCRIPTION OF THE DRAWINGS

For a further understanding of the nature and objects of the present invention, reference should be had to the following detailed description, taken in conjunction with the accompanying drawing, in which like parts are given like reference numerals and, wherein.

DETAILED DESCRIPTION OF THE PREFERRED EMBODIMENT

Figure 1:
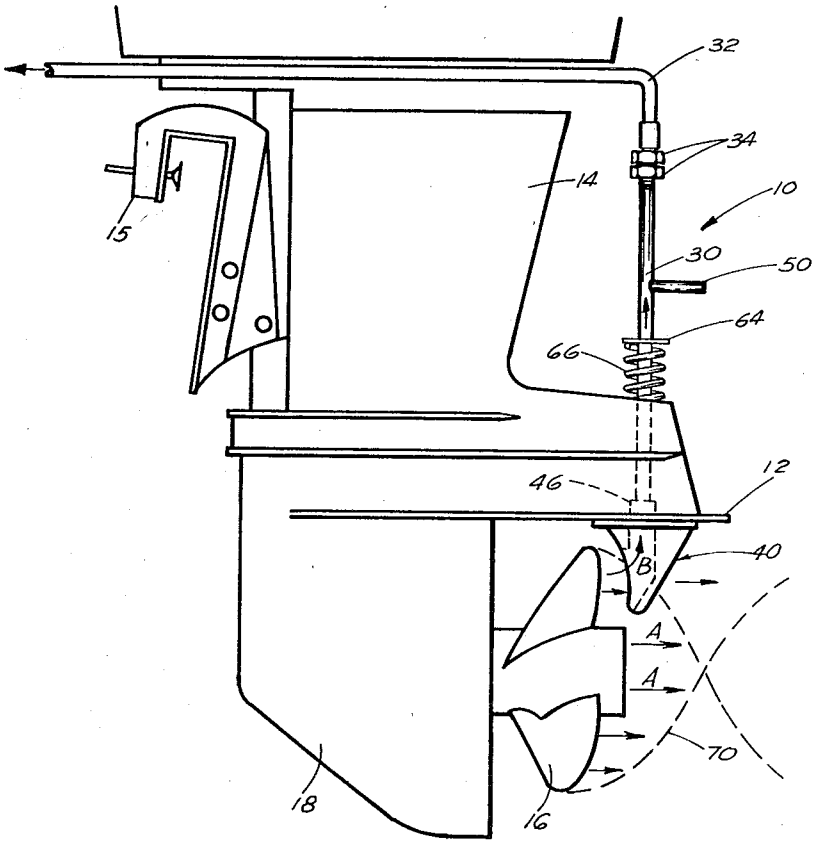
FIG. 1 is a side elevational view showing the apparatus of the present invention secured to the outboard motor of a boat and having a tube connected to a trim tab having a passageway therethrough for injecting water into the boat.
Figure 2:
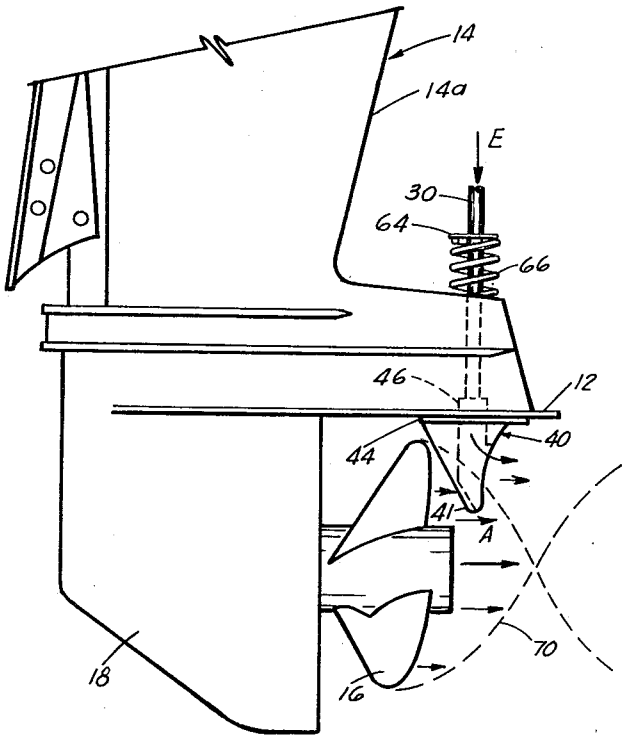
FIG. 2 is a partial side elevational view showing the apparatus of the present invention secured to the outboard motor of a boat and having a tube connected to a passageway in the trim tab for extracting water from the bilge of the boat.

FIGS. 1 and 2 best illustrate the preferred embodiment of the present invention designated generally by the numeral 10. In FIG. 1 there can be seen cavitation plate 12 of an outboard motor 14 having the usual housing 14*a* propeller 16 and skeg 18 (while an outboard motor 14 is depicted, the apparatus of the present invention is just as suitable for an inboard motor). The outboard motor 14 is secured to the frame or transom of a boat (not shown) by suitable clamp 15. Cavitation plate 12 has a recessed area 17 provided in the lower surface thereof and has a pair of recesses 13 in surface 19 of slot 17 of cavitation plate 12. A trim tab 40 having a generally fin-shaped body 42 projects downwardly from cavitation plate 12. Trim tab 40 is formed integrally with plate 44 (shown in phantom view in FIG. 3 as plate 44') which has projections 48 (shown as 48' in phantom view in FIG. 3) extending above its upper surface which mate in recesses 13 of slot 17 of cavitation plate 12 just as horizontal plate 44 mates in slot 17 of cavitation plate 12. In this manner trim tab 40 can securely assume the position of FIGS. 1 and 2. Trim tab 40 further has integrally formed with its upper horizontal plate 44 and projecting above the surface of plate 44 a collar 46 which is internally threaded (not shown) and which is accepted in bore 11 of cavitation plate 12, as best shown in FIG. 2. Trim tab 40 is further provided with a fluid passageway 43 extending through fin-shaped body 42 and upper horizontal plate 44 to collar 46.

An elongated tubular member 30 positioned with one threaded end 32 threadably connected to collar 46 of trim tab 40 extends upwardly through motor housing 14*a* and through annular bracket 62 mounted on motor housing 14*a* for connection, by conventional fastening means such as nuts 34, to a second flexible tubular member indicated by numeral 32 which terminates in the bilge of the boat (not shown). Tubular member 30 has fixedly provided thereon and above bracket 62 an annular bracket 64 providing a shoulder 65 which together with annular shoulder 63 of bracket 62 confines a helical spring 66. The positioning of spring 66 between shoulders 63 and 65 of annular brackets 62 and 65 respectively provides biasing of tubular member 30 upwardly or in the direction of ARROW C as annular portion 64 is integral with tube 30 and bracket 62 is affixed to outboard motor housing 14. In this manner horizontal plate 44 and projections 48 are maintained in slot 17 and recesses 13 respectively for maintaining trim tab 40 in the position of FIGS. 1 or 2. Tubular member 30 is further provided with a laterally depending handle 50 for imparting either vertical or rotational movement to tubular member 30 for operational purposes to be described further herein.

Figure 3:
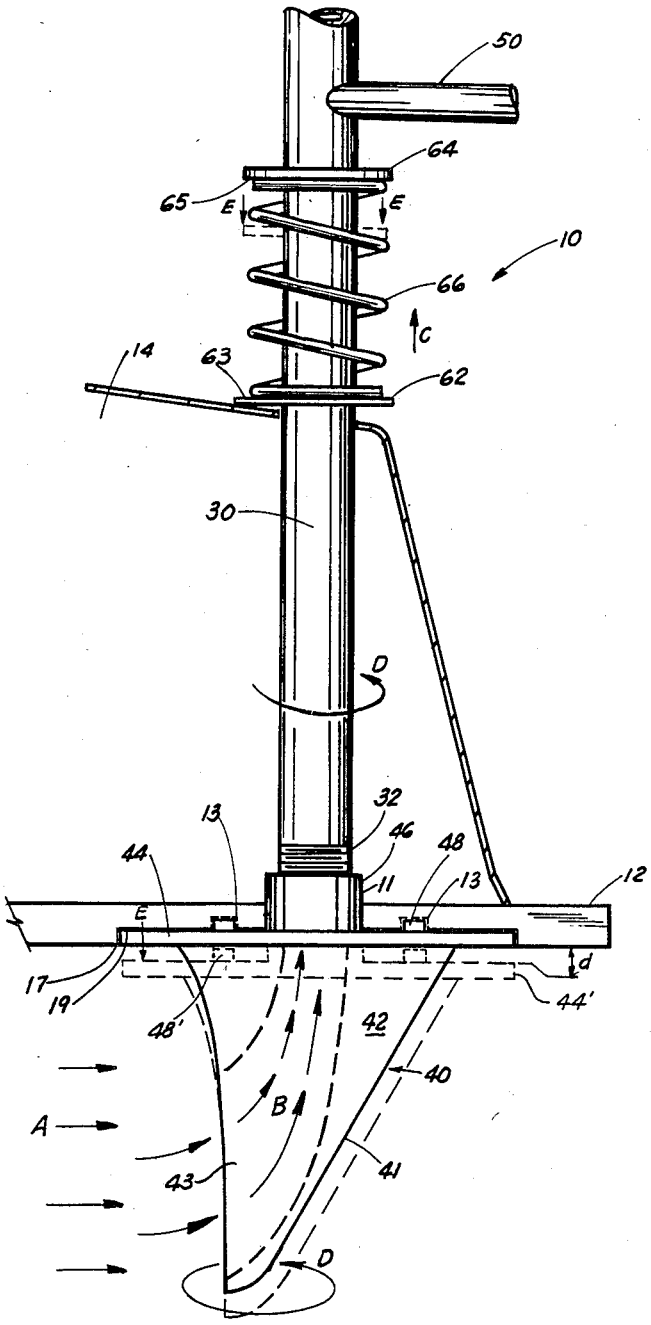
FIG. 3 is a detailed side elevational view showing the details of construction of the trim tab, tubular member and spring biasing means of the apparatus of the present invention in the position of FIG. 1.

Turning now to the operation of the apparatus of the present invention 10 in the position of FIGS. 1 and 3, the water from propeller 16, which assumes the path 70 of the general direction of ARROW A, will be forced through passageway 43 of trim tab 40 in the direction of ARROW B and then through the bore (not shown) in horizontal plate 44 and bore 11 in cavitation plate 12 and into tubular member 30 in the direction of ARROW C and through second tubular member 32 to the boat for its ultimate end use, be it a supply of aerated water for a live well for fish, washing the boat down while preparatory to storing the boat during a period of non-use or the like. It can be understood that apparatus 10 of the present invention while in the position of FIGS. 1 and 3 operates to provide a supply of water to the boat at all times propeller 16 is rotating and does not depend upon movement of the boat through the water or electronic circuitry to activate a pump.

Should the boat operator prefer to extract bilge water from the bilge of the boat, apparatus 10 of the present invention can be rotated from the position of FIGS. 1 and 3 to the position of FIG. 2. To accomplish such rotation, handle 50 is manually engaged and a downward force in the direction of ARROW E is imparted to the same. This downward force on handle 50 will move tubular member 30 and thus annular bracket 64 downwardly against the bias of spring 66 seated on annular shoulder 63 of bracket 62. The movement of tubular section 30 a sufficient distance "d" such as that illustrated in FIG. 3, will disengage protrusions 48 from recesses 13 and plate 44 from slot 17 of cavitation plate 12 thereby freeing trim tab 40 from its interconnection with cavitation plate 12. Thus the phantom position of trim tab 40 illustrated in FIG. 3 is assumed. Upon trim tab 40 assuming the position of FIG. 3, rotational movement in the direction of ARROW D (or opposite ARROW D) can take trim tab 40 through a 180 degree rotation to the position of FIG. 2. At that point the downward force in the direction of ARROW E on handle 50 can be slowly released and protrusions 48 and slot 44 will again mate respectively with recesses 13 and slot 17 in the lower surface of cavitation plate 12, all so that trim tab 40 is again securely interconnected to cavitation plate 12 and rotational or other movement thereof is prevented. The biasing of tubular member 30 in a direction of ARROW C by spring 66 maintains such secure interconnection.

With the apparatus of the present invention 10 in the position of FIG. 2 and fluid passageway 43 of trim tab 40 facing away from propeller 16, water from the propeller will flow over solid backside 41 of fin-shaped body 42 creating a vacuum in passageway 43 and tubular members 30, 32 for extracting bilge water from the boat. It can be understood that apparatus 10 of the present invention operates to extract bilge water from the boat at all times that propeller 16 is rotating and does not depend upon movement of the boat through the water.

Figure 4:
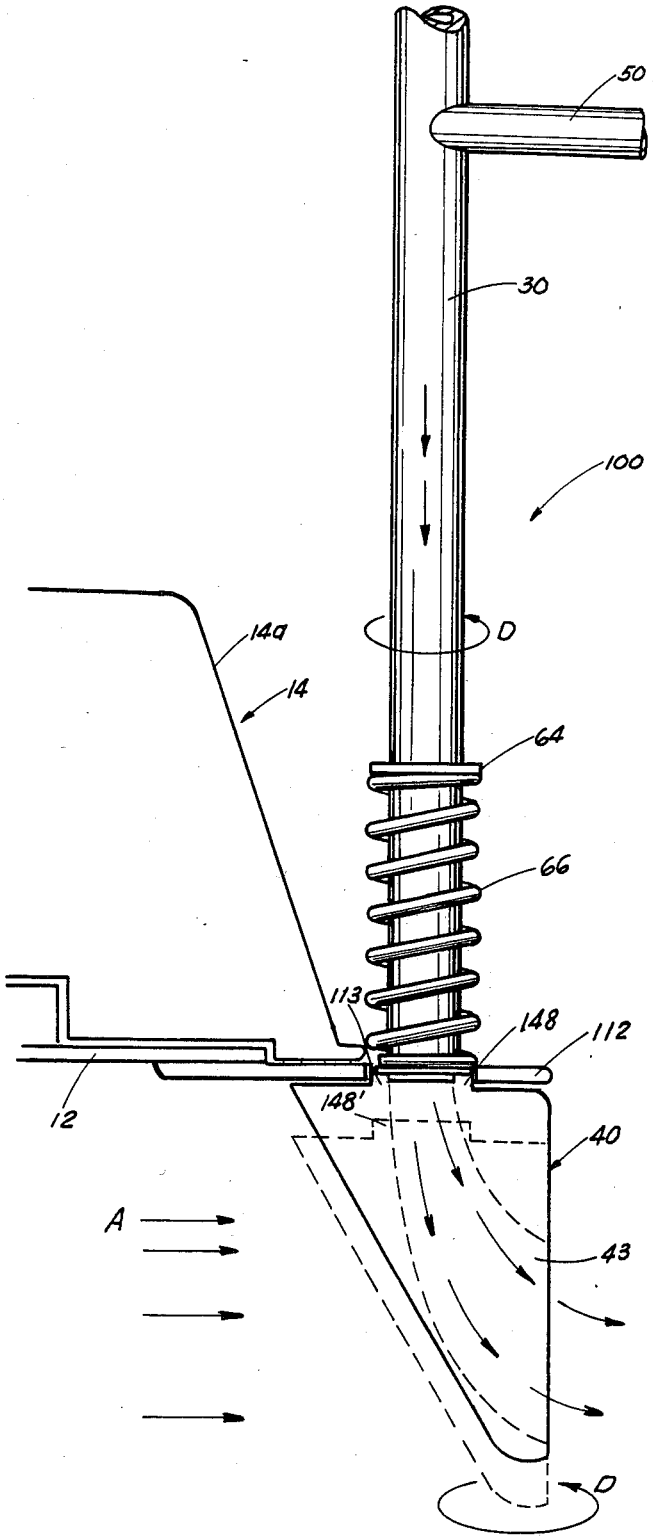
FIG. 4 is a partial side elevational view showing an alternate embodiment of the apparatus of the present invention for extracting water from the bilge of the boat.

In the alternate embodiment 100 of the present invention, best seen in FIG. 4, tubular member 30 may connect to passageway 43 in trim tab 40 through an extension 112 of cavitation plate 12 which terminates aft of motor housing 14*a* such that tubular member 30 does not pass through motor housing 14*a*. This arrangement would obviate the need for annular bracket 62 as spring 66 can be mounted on cavitation plate extension 112 between the same and annular bracket 64. The alternate embodiment provides for but one protrusion 148 projecting upwardly from trim tab 40, protrusion 148 being accommodated by annular recess 113 in cavitation plate extension 112. The operation of apparatus 100 in the alternate embodiment of FIG. 4 produces a result identical to the operation of apparatus 10 of the preferred emobidment.

Because many and varying and different embodiments may be made within the scope of the inventive concept herein taught, and because many modifications may be made in the embodiments herein detailed in accordance with the descriptive requirement of the law, it to be understood that the details herein are to be interpreted as illustrative and not in a limiting sense.

What is claimed as invention is:

1. A water ejector and injector attachment for the motor of a boat comprising:

a. a motor adapted to be secured to the frame of said boat having a propeller at the lower end thereof and defining:
   i. a cavitation plate extending rearwardly thereof and having:
      A. a bore therethrough; and
      B. at least one recess in the lower surface thereof; a
   ii. a trim tab projecting downwardly from said cavitation plate and positioned adjacent and rearward of said propeller, said trim tab and having:
      A. a passageway therethrough having one end communicating with said bore of said cavitation plate; and
      B. a plate member integral therewith and having at least on protrusion upwardly extending therefrom, each of said at least one protrusion selectively mating in said at least one recess in said lower surface of said cavitation plate thereby securing said trim tab to said cavitation plate;

b. an elongated tubular member for providing a passageway for fluid provided through said bore in said cavitation plate and having one end secured to said trim tab and communicating with said passageway of said trim tab and its other end terminating in said boat; and c. means for biasing said trim tab upwardly thereby engaging said at least one protrusion within said at least one recess.

2. The apparatus of claim 1 further comprising means for moving said trim tab against the bias of said biasing means for disengaging said at least one protrusion from mating relationship with said at least one recess thereby allowing rotation of said trim tab from a first position wherein said passageway in said trim tab faces said propeller thereby creating a force for introducing fluid into said boat, to a second position wherein said passageway in said trim tab faces away from said propeller thereby creating a vacuum therein for extracting fluid from said boat.

3. The apparatus of claim 2 wherein said means for moving said trim tab against the bias of said biasing means includes a handle extending laterally from said tubular member.

4. The apparatus of claim 1 wherein said biasing means includes a spring mounted between an annular shoulder portion provided on said tubular member and an annular shoulder portion provided on said motor.

5. The apparatus of claim 1 wherein said trim tab is generally fin-shaped.

6. A water ejector and injector attachment for the motor of a boat comprising:

a. a motor adapted to be secured to the frame of said boat having a propeller at the lower end thereof and defining:
   i. a cavitation plate extending rearwardly thereof and having:
      A. a bore therethrough; and
      B. at least one recess in the lower surface thereof; and
   ii. a trim tab projecting downwardly from said cavitation plate and positioned adjacent and rearward of said propeller, said trim tab having:
      A. a passageway therethrough having one end communicating with said bore of said cavitation plate; and
      B. a plate member integral therewith and having at least one protusion upwardly depending therefrom, each of said at least one protrusion selectively mating in said at least one recess in said lower surface of said cavitation plate thereby securing said trim tab to said cavitation plate;

b. an elongated tubular member for providing a passageway for fluid provided through said bore in said cavitation plate and having one end secured to said trim tab and communicating with said passageway of said trim tab and its other end terminating in said boat;

c. means for biasing said trim tab upwardly, thereby engaging said at least one protrusion within said at least one recess and d. means for moving said trim tab against the bias of said biasing means for disengaging said at least one protrusion from mating relationship with said at least one recess thereby allowing rotation of said trim tab from a first position wherein said passageway in said trim tab faces said propeller thereby creating a force for introducing fluid into said boat, to a second position wherein said passageway in said trim tab faces away from said propeller thereby creating a vacuum therein for extracting fluid from said boat.

7. The apparatus of claim 6 wherein said means for moving said trim tab against the bias of said biasing means includes a handle depending laterally from said tubular member.

8. The apparatus of claim 6 wherein said biasing means includes a spring mounted between an annular shoulder portion provided on said tubular member and an annular shoulder portion provided on said motor.

9. The apparatus of claim 6 wherein said trim tab is generally fin-shaped.

10. A water ejector and injector attachment for the motor of a boat comprising:

a. a motor adapted to be secured to the frame of said boat having a propeller at the lower end thereof and defining:
   i. a cavitation plate extending rearwardly thereof and having:
      A. a bore therethrough; and
      B. at least one recess in the lower surface thereof; and
   ii. a trim tab projecting downwardly from said cavitation plate and positioned adjacent and rearward of said propeller, said trim tab being generally fin-shaped and having:
      A. a passageway therethrough having one end communicating with said bore of said cavitation plate; and
      B. a plate member integral therewith and having at least one protrusion upwardly extending therefrom, each of said at least one protrusion selectively mating in said at least one recess in said lower surface of said cavitation plate thereby securing said trim tab to said cavitation plate;

b. an elongated tubular member for providing a passageway for fluid provided through said bore in said cavitation plate and having one end secured to said trim tab and communicating with said passageway of said trim tab and its other end terminating in said boat;

c. means for biasing said trim tab upwardly thereby engaging said at leat one protrusion within said at least one recess including a spring mounted between an annular shoulder portion provided on said tubular member and an annular shoulder portion provided on said motor; and d. means for moving said trim tab against the bias of said biasing means for disengaging said at least one protrusion from mating relationship with said at least one recess thereby allowing rotation of said trim tab from a first position wherein said passageway in said trim tab faces said propeller thereby creating a force for introducing fluid into said boat, to a second position wherein said passageway in said trim tab faces away from said propeller thereby creating a vacuum therein for extracting fluid from said boat.

11. The apparatus of claim 10 wherein said means for moving said trim tab against the bias of said biasing means includes a handle extending laterally from said tubular member.

* * * * *